US006417613B1

(12) United States Patent
Kyono

(10) Patent No.: US 6,417,613 B1
(45) Date of Patent: Jul. 9, 2002

(54) CATHODE RAY TUBE GLASS PANEL

(75) Inventor: Masaya Kyono, Nagahama (JP)

(73) Assignee: Nippon Electric Glass Co., Ltd., Shiga (JP)

( * ) Notice: Subject to any disclaimer, the term of this patent is extended or adjusted under 35 U.S.C. 154(b) by 0 days.

(21) Appl. No.: 09/582,515

(22) PCT Filed: Dec. 21, 1999

(86) PCT No.: PCT/JP99/07185

§ 371 (c)(1),
(2), (4) Date: Jun. 27, 2000

(87) PCT Pub. No.: WO00/41204

PCT Pub. Date: Jul. 13, 2000

(30) Foreign Application Priority Data

Dec. 28, 1998 (JP) ..... 10-373361

(51) Int. Cl.[7] ..... H01J 31/00

(52) U.S. Cl. ..... 313/477 R; 313/402; 313/461; 313/478; 220/2.1 A; 220/2.3 A

(58) Field of Search ..... 313/477 R, 461, 313/402, 407, 408, 479; 220/2.1 A, 2.3 A, 2.3 R

(56) References Cited

U.S. PATENT DOCUMENTS 5,536,995 A * 7/1996 Sugawara et al. ..... 313/477 R
5,925,977 A * 7/1999 Sugawara et al. ..... 313/477 R
5,962,964 A * 10/1999 Sano et al. ..... 313/477 R
6,114,803 A * 9/2000 Hosotani ..... 313/461
6,236,151 B1 * 5/2001 Murakami et al. ..... 313/402
6,268,692 B1 * 7/2001 Yokota et al. ..... 313/477 R

FOREIGN PATENT DOCUMENTS

| | | |
|---|---|---|
| GB | 2322731 | 2/1998 |
| GB | 2318905 | 6/1998 |
| GB | 2321899 | 12/1998 |
| JP | 4856/1978 | 1/1978 |

* cited by examiner

*Primary Examiner*—Ashok Patel
*Assistant Examiner*—M. Santiago
(74) *Attorney, Agent, or Firm*—Armstrong, Westerman & Hattori, LLP

(57) ABSTRACT

In a glass panel for cathode ray tube of which effective screen diameter D along the diagonal axis of the glass panel is more than or equal to 500 mm, and average radius of curvature of an outer surface of a face portion 11 is more than or equal to 10,000 mm, when a distance h along a tube axis from a contact between an effective screen end of an inner surface of the glass panel and a blend R portion 12 to a seal edge surface 14 is defined as a length of a skirt portion 13, and a glass wall thickness of the seal edge surface 14 of the skirt portion is defined as t, ranges of h and t are specified by ratios with respect to the effective screen diameter D, and a product of h and t is also specified to satisfy a predetermined range in relation to the effective screen diameter D. In this way, deformation of the skirt portion due to inclination is suppressed, reduction in mechanical strength due to shortening of the skirt portion is compensated by the glass wall thickness of the seal edge surface, and thus weight reduction of the glass panel is accomplished while retaining the predetermined mechanical strength.

3 Claims, 6 Drawing Sheets

CATHODE RAY TUBE GLASS PANEL

BACKGROUND OF THE INVENTION

1. Field of the Invention

The present invention relates to a glass bulb used in a cathode ray tube, and particularly to a glass panel constituting a front surface portion of the glass bulb.

2. Description of the Related Art

As shown in FIG. 3, a glass bulb 1 used in a cathode ray tube generally comprises a glass panel 10 serving as a front surface portion, a funnel 20 serving as a back structural member and a neck 30 for mounting an electron gun therein. The glass panel 10 includes a face portion 11 of substantially rectangular shape having an effective screen for displaying an image, and a skirt portion 13 continued from the periphery of the face portion 11 via a blend R portion 12 and having a seal edge surface 14 for sealing with the funnel 20. In the case of a color cathode ray tube, the glass panel 10 is sealed between the seal edge surface 14 of the skirt portion 13 and a seal edge surface of the funnel 20 via frit glass and the like.

Since the glass bulb 1 for cathode ray tube is used as a vacuum vessel of which interior is evacuated to vacuum, a stress caused by a pressure difference between inside and outside of the bulb will act on the outer surface of the glass bulb 1. In the case of the glass bulb 1 which is not a spherical shell, however, as shown in FIG. 4, there arises complicated distribution of stress such that an area of tensile stress denoted by arrows toward outside of the bulb and an area of compressive stress denoted by arrows toward inside of the bulb are present at the same time.

The vacuum tensile stress generated in the glass bulb 1 usually becomes maximum in the area ranging from an end of the face portion on the short axis of the glass panel 10 to the skirt portion, and when a mechanical or thermal shock exceeding a certain degree is applied to the glass bulb 1 from the outside, the glass bulb 1 is broken from the vicinity of the region where the maximum vacuum tensile stress is generated, that is the area ranging from the end of the face portion 11 to the skirt portion 13 as its origin of breakage, resulting in implosion. Therefore, the glass bulb 1 used in a cathode ray tube is usually designed to have an enough mechanical strength to suppress the vacuum tensile stress to a predetermined value or less.

Though the distribution of vacuum tensile stress depends on the size and shape of the glass bulb, the design of shape, wall thickness and the like is made so as to suppress the vacuum tensile stress generated at the seal edge portion between the glass panel and the funnel to less than 8.4 MPa, which is one standard of mechanical strength required for a glass bulb determined in consideration of safety factors such as shocks applied from the outside.

For this reason, in conventional glass panels for cathode ray tube, in order to suppress the vacuum tensile stress to less than the predetermined value while retaining the mechanical strength at the time of being used for a glass bulb, such measures have been taken as increasing the wall thickness of the glass, elongating the skirt portion for relieving and distributing the vacuum tensile stress generated in the vicinity of the skirt portion to thereby reduce the peak value thereof, and the like.

In conventional glass panels for cathode ray tube, however, since the weight of the glass is increased because of the increased wall thickness of the glass or the elongated skirt potion, there is a problem that the glass panel is inferior in operability and workability. In particular, as for the glass panel whose skirt portion is elongated, since the glass panel immediately after forming has not been sufficiently solidified, there arises a problem that the skirt portion tends to incline toward inside or outside and thus the glass panel is easy to deform.

In view of the above, it is an object of the present invention to provide a glass panel for cathode ray tube of large size having a high flatness of a face portion, which realizes weight reduction by shortening a skirt portion while retaining the predetermined mechanical strength as a glass bulb, as well as suppresses deformation immediately after forming.

SUMMARY OF THE INVENTION

The present invention was accomplished for solving the above-mentioned problems, by using various sizes of glass panels for cathode ray tube and measuring a panel weight and maximum vacuum tensile stress when used as a glass bulb for a plurality of samples having different skirt lengths and glass wall thicknesses of seal edge surface.

That is, a glass panel for cathode ray tube according to the present invention comprises a face portion of substantially rectangular shape, and a skirt portion connected with a periphery of the face portion via a blend R portion and having a seal edge surface for sealing with a funnel, and is characterized in that an effective screen diameter D(mm) of the glass panel along a diagonal axis thereof is in the range of $500 \leqq D < 650$; an average radius of curvature of an outer surface of the face portion is more than or equal to 10,000 mm in any radial direction passing the center of the face portion; and a distance h(mm) along a tube axis from a contact between an effective screen end of an inner surface of the glass panel and the blend R portion to the seal edge surface at least in a short axis of the glass panel, and a glass wall thickness t (mm) of the seal edge surface satisfy the relationships of: $0.07D \leqq h \leqq 0.11D$, $0.015D \leqq t \leqq 0.025D$ and $(D/25.4)^2 \leqq t \times h \leqq (D/25.4+3)^2$.

Furthermore, a glass panel for cathode ray tube according to the present invention is characterized in that an effective screen diameter D(mm) of the glass panel along a diagonal axis thereof is more than or equal to 650; an average radius of curvature of an outer surface of the face portion is more than or equal to 10,000 mm in any radial direction passing the center of the face portion; and a distance h(mm) along a tube axis from a contact between an effective screen end of an inner surface of the glass panel and the blend R portion to the seal edge surface at least in a short axis of the glass panel, and a glass wall thickness t (mm) of the seal edge surface satisfy the relationships of: $0.08D \leqq h \leqq 0.11D$, $0.015D \leqq t \leqq 0.020D$ and $(D/25.4)^2 \leqq t \times h \leqq (D/25.4+2.5)^2$.

According to the present invention, in a glass panel for cathode ray tube having a large size with an effective screen diameter D along the diagonal axis of the glass panel of more than or equal to 500 mm, and a high flatness with an average radius of curvature of the outer surface of a face portion of more than or equal to 10,000 mm, when a distance h along a tube axis from a contact between an effective screen end of an inner surface of the glass panel and a blend R portion to a seal edge surface is defined as a length of a skirt portion, and a glass wall thickness of the seal edge surface of the skirt portion is defined as t, ranges of h and t are specified by ratios with respect to the effective screen diameter D which is a substantial size of the glass panel, and a product of h and t is also specified to satisfy a predetermined range in relation to the effective screen diameter D, from the view point of mechanical strength and weight reduction. In this way, deformation of the skirt portion due to inclination is suppressed, reduction in mechanical strength due to shortening of the skirt portion is compensated by the glass wall thickness of the seal edge surface, and thus weight reduction of the glass panel is accomplished while retaining the predetermined mechanical strength.

The reason why these specifications were made on the short axis of the glass panel is that the maximum vacuum tensile stress on the glass bulb is usually generated in the region ranging from the end of the face portion to the skirt portion on the short axis of the glass panel.

In the case of a glass panel for cathode ray tube having an effective screen diameter D (mm) of $500 \leqq D < 650$, when the length h of the skirt portion and the glass wall thickness t of the seal edge surface of the skirt portion are set in the ranges of $0.07D > h$ and/or $0.015D > t$, or $t \times h < (D/25.4)^2$, the skirt portion becomes too short and the wall thickness t of the seal edge portion is too small, causing the vacuum tensile stress value of the seal edge portion generated by evacuation of the glass bulb to become more than 8.4 MPa, so that it is impossible to obtain the desirable mechanical strength required for a glass bulb.

On the other hand, when $h > 0.11D$, the length of the skirt portion cannot be shortened, so that weight reduction of the glass panel cannot be accomplished and the skirt portion is likely to deform by inclination immediately after forming of the glass panel. Further, when $t > 0.025D$ or $(D/25.4+3)^2 < t \times h$, it is impossible to reduce the weight of the glass panel.

In the case of a glass panel for cathode ray tube having an effective screen diameter D (mm) of more than or equal to 650, when the length h of the skirt portion and the glass wall thickness t of the seal edge surface of the skirt portion are set in the ranges of $0.08D > h$ and/or $0.015D > t$, or $t \times h < (D/25.4)^2$, the skirt portion becomes too short and the wall thickness of the seal edge portion is too small, causing the vacuum tensile stress value of the seal edge portion generated by evacuation of the glass bulb to become more than 8.4 MPa, so that it is impossible to obtain the desirable mechanical strength required for a glass bulb.

On the other hand, when $h > 0.11D$, the length of the skirt portion cannot be shortened, so that weight reduction of the glass panel cannot be accomplished and the skirt portion is likely to deform by inclination immediately after forming of the glass panel. Further, when $t > 0.020D$ or $(D/25.4+2.5)^2 \leqq t \times h$, it is impossible to reduce the weight of the glass panel.

DETAILED DESCRIPTION OF THE PREFERRED EMBODIMENT

Figure 1:
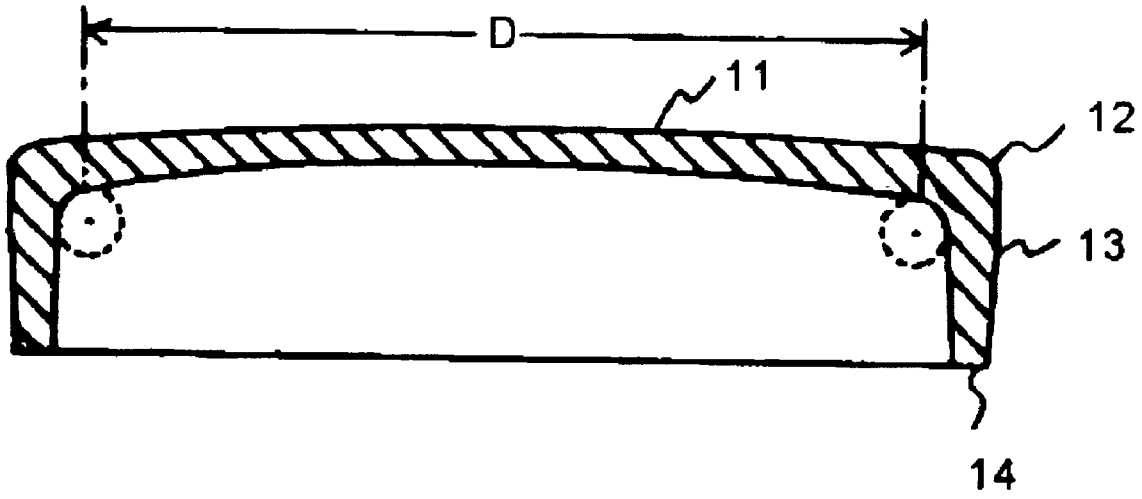
FIG. 1 is an explanatory view in diagonal axial section of a glass panel for cathode ray tube according to the present invention.
Figure 2:
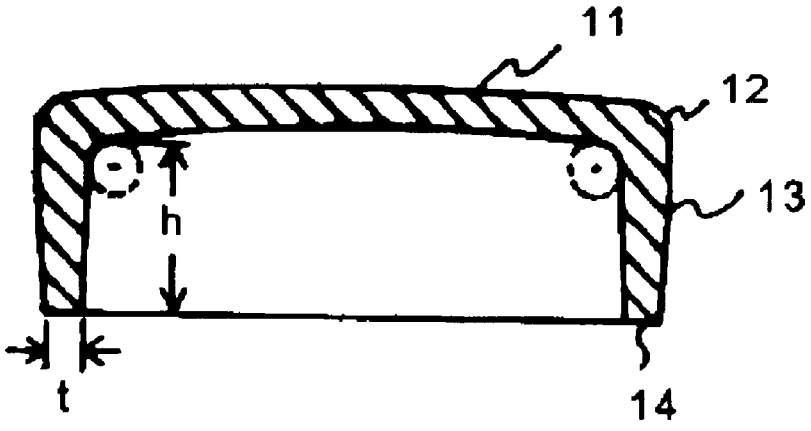
FIG. 2 is an explanatory view in short axial section of the glass panel for cathode ray tube according to the present invention.
Figure 3:
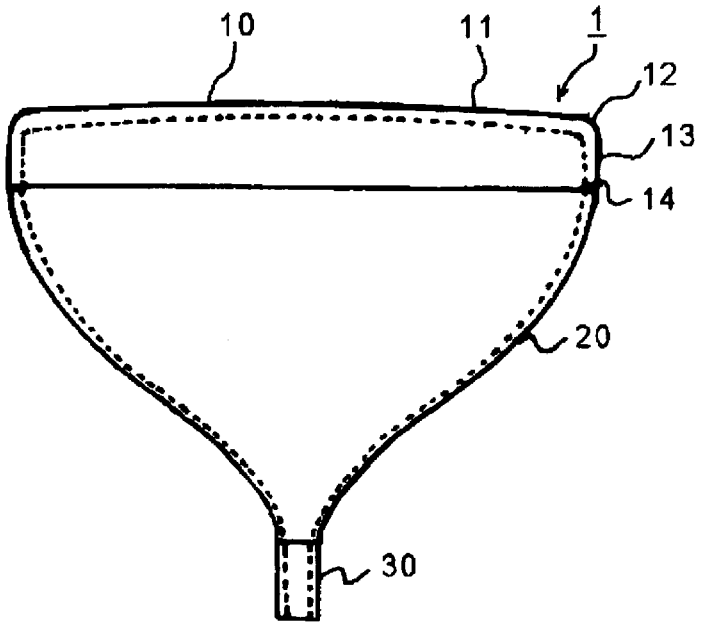
FIG. 3 is an explanatory view of a glass bulb for cathode ray tube.
Figure 4:
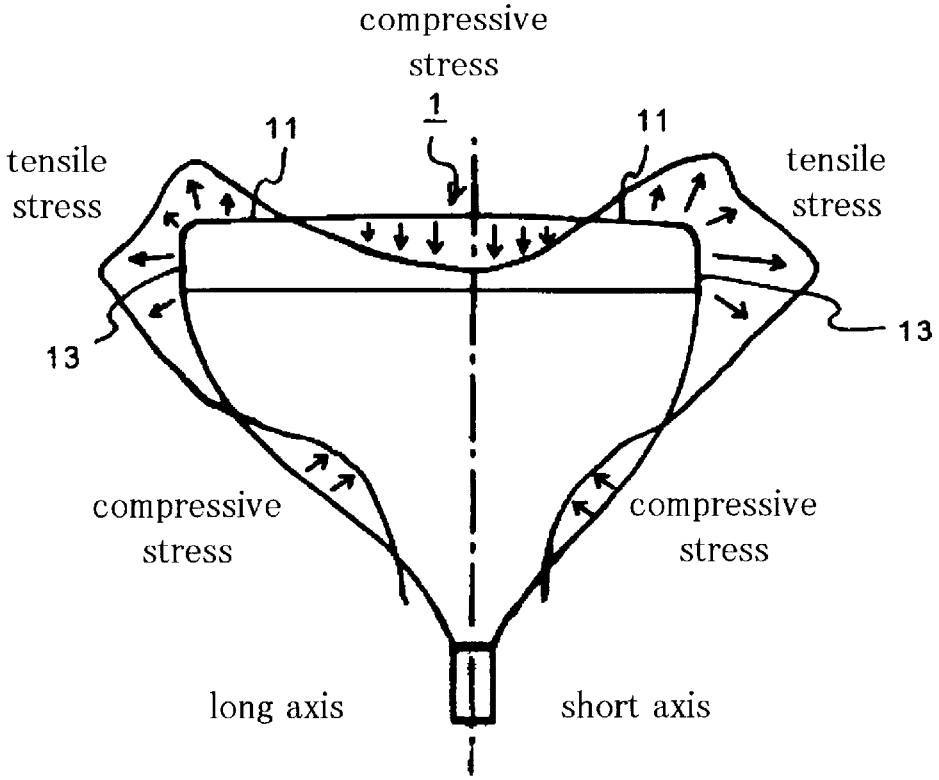
FIG. 4 is an explanatory view of a distribution of vacuum stress generated in the glass bulb for cathode ray tube.

In the followings, a glass panel for cathode ray tube according to the present invention will be described with reference to the examples. FIG. 1 is an explanatory view in diagonal axial section of a glass panel for cathode ray tube according to the present invention, and FIG. 2 is an explanatory view in short axial section of the same. The components as same as those described above will be denoted by the same reference numerals and explanations thereof will be omitted.

In drawings, the reference numeral "h" denotes a distance along the tube axis in the short axis of the glass panel 10 from a contact between an effective screen end of the inner surface of the glass panel 10 and the blend R portion 12 to the seal edge surface 14 of the skirt portion 13, which is then defined as the length of the skirt portion. The reference numeral "t" denotes a glass wall thickness of the seal edge surface 14 of the skirt portion 13.

Glass panels for cathode ray tube according to the present invention and comparative glass panels as comparative examples were individually manufactured. After measuring the weight of each glass panel, and sealing a funnel and a neck to each glass panel thereby making a glass bulb, the air was exhausted from the interior thereof, and then a vacuum tensile stress value of seal edge portion of each glass bulb was measured by means of a strain gauge. Mechanical strength of a glass bulb was evaluated by measuring the vacuum tensile stress value generated at the seal edge portion.

Tables. 1 to 4 show dimension of each portion, weight of glass panel, and vacuum tensile stress value generated at the seal edge portion when used as a glass bulb of each glass panel for cathode ray tube, for four glass panels for cathode ray tube having different effective screen diameters D along the diagonal axis of the glass panel. In each Table, Sample 1 is a conventional example.

Table 1 shows data of a panel for cathode ray tube of which effective screen diameter D along the diagonal axis of the glass panel is 510 mm (21 inches), aspect ratio is 4:3, center wall thickness of the face portion is 15 mm, and minimum average radius of curvature of the outer surface of the face portion is 33,000 mm.

In Table 1, the panels for cathode ray tube according to the present invention represented by Samples 2 to 9 resulted in that the weight was reduced by about 1 kg at the maximum compared to the conventional panel for cathode ray tube of Sample 1, and that the vacuum tensile stress at the seal edge portion when used as a glass bulb was less than the standard value of 8.4 MPa for all Samples. Further, in the panels for cathode ray tube according to the present invention, the amount of inclination/deformation of the skirt portion immediately after forming was much suppressed compared to the conventional panel for cathode ray tube of Sample 1.

Samples 10 to 14 show comparative examples, and as for Samples 10 to 12, though the weight was reduced compared to Sample 1 of the conventional example, it was impossible to suppress the vacuum tensile stress to less than 8.4 MPa. As for Samples 13 and 14 of comparative examples, though the vacuum tensile stress was suppressed to less than 8.4 MPa, it was impossible to reduce the weight less than that of Sample 1 of the conventional example.

Figure 5:
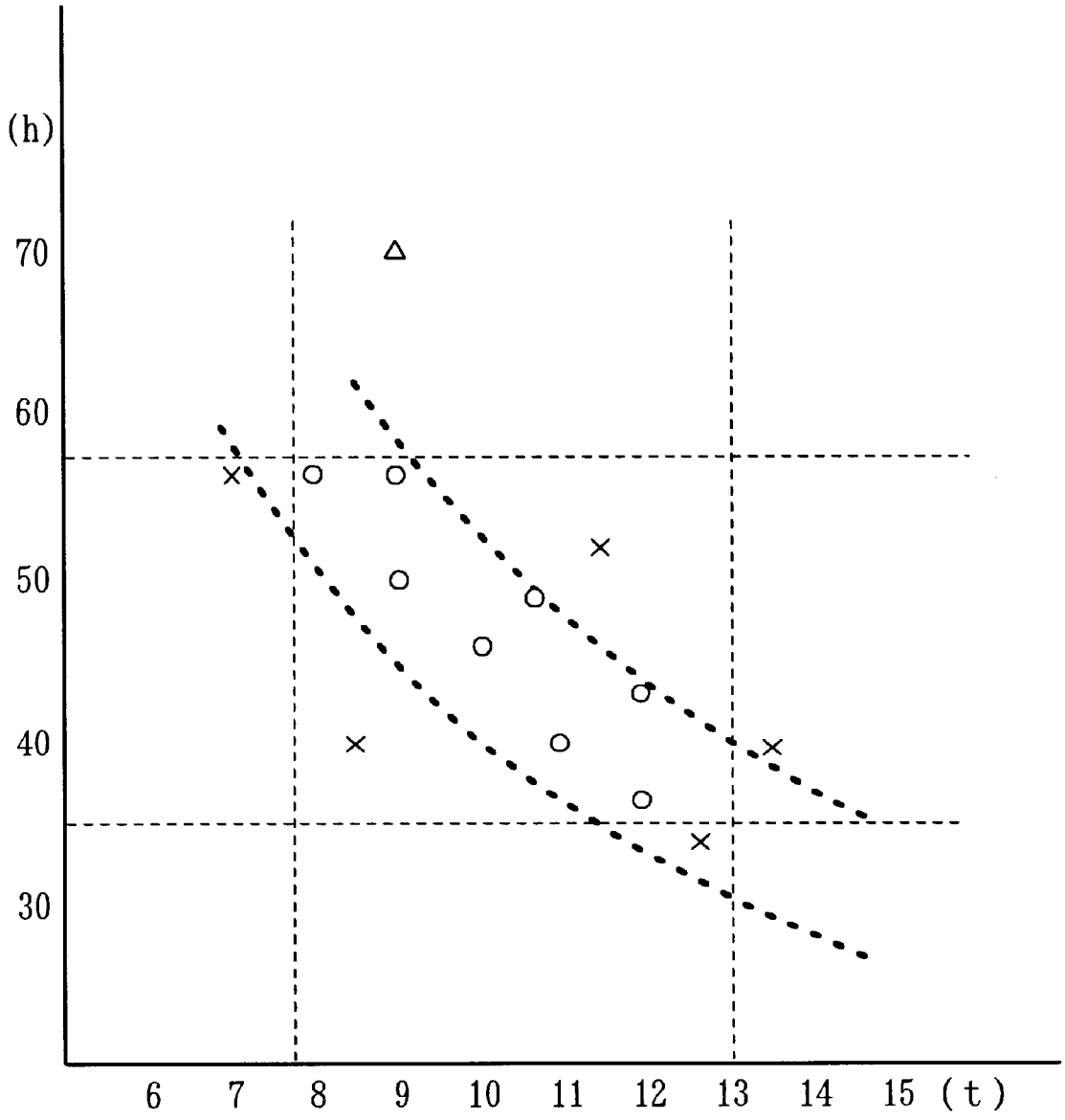
FIG. 5 is a graph showing the data of Table 1 wherein the horizontal axis represents "t" and the vertical axis represents "t"

FIG. 5 is a graph showing the data of Table 1 wherein the horizontal axis represents "t" and the vertical axis represents "h". The symbol Δ represents Sample 1 which is the conventional example, the symbol ○ represents glass panels of Samples 2 to 9 according to the present invention wherein the desired mechanical strength and weight reduction required for a glass bulb were accomplished, and the symbol X represents Samples 10 to 14 which are the comparative examples wherein at least one of the desired mechanical strength and weight reduction required for a glass bulb was not accomplished. The dotted lines shown in FIG. 5 denote graphs of: h=0.07D, h=0.11D, t=0.015D, t=0.025D, $t \times h=(D/25.4)^2$, and $t \times h=(D/25.4+3)^2$, respectively.

Table 2 shows data of a panel for cathode ray tube of which effective screen diameter D along the diagonal axis of the glass panel is 600 mm (25 inches), aspect ratio is 4:3, center wall thickness of the face portion is 14.8 mm, and minimum average radius of curvature of the outer surface of the face portion is 30,000 mm.

In Table 2, the panels for cathode ray tube according to the present invention represented by Samples 2 to 9 resulted in that the weight was reduced by about 1 kg at the maximum compared to the conventional panel for cathode ray tube of Sample 1, and that the vacuum tensile stress at the seal edge portion when used as a glass bulb was less than the standard value of 8.4 MPa for all Samples. Further, in the panels for cathode ray tube according to the present invention, the amount of inclination/deformation of the skirt portion immediately after forming was much suppressed compared to the conventional panel for cathode ray tube of Sample 1.

Samples 10 to 14 show comparative examples, and as for Samples 10 to 12, though the weight was reduced compared to Sample 1 of the conventional example, it was impossible to suppress the vacuum tensile stress to less than 8.4 MPa. As for Samples 13 and 14 of comparative samples, though the vacuum tensile stress was suppressed to less than 8.4 MPa, it was impossible to reduce the weight less than that of Sample 1 of the conventional example.

Figure 6:
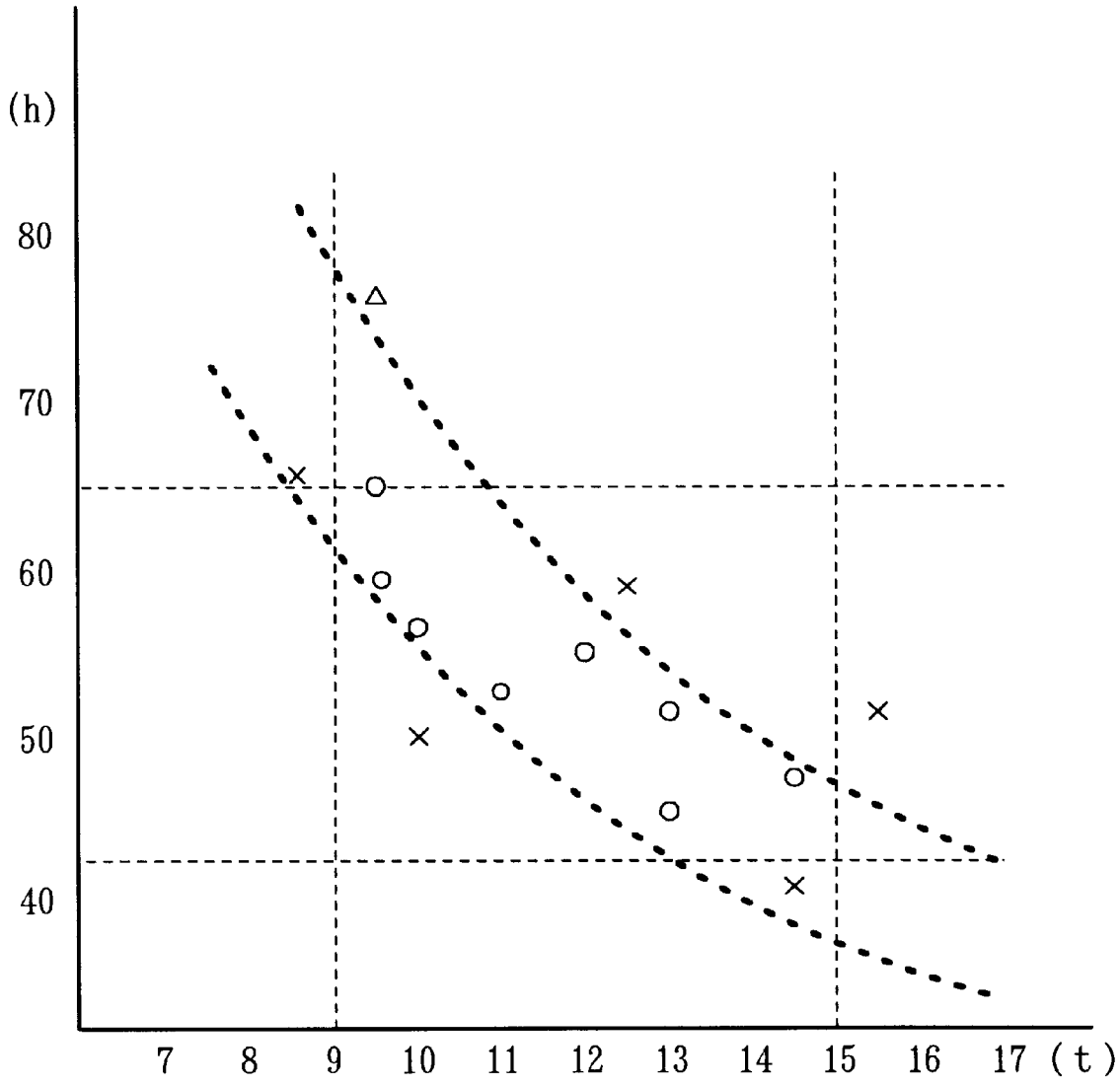
FIG. 6 is a graph showing the data of Table 2 wherein the horizontal axis represents "t" and the vertical axis represents "h"

FIG. 6 is a graph showing the data of Table 2 wherein the horizontal axis represents "t" and the vertical axis represents "h". The symbol Δ represents Sample 1 which is the conventional example, the symbol ○ represents glass panels of Samples 2 to 9 according to the present invention wherein the desired mechanical strength and weight reduction required for a glass bulb were accomplished, and the symbol X represents Samples 10 to 14 which are the comparative examples wherein at least one of the desired mechanical strength and weight reduction required for a glass bulb was not accomplished. The dotted lines shown in FIG. 6 denote graphs of: h=0.07D, h=0.11D, t=0.015D, t=0.025D, $t \times h=(D/25.4)^2$, and $t \times h=(D/25.4+3)^2$, respectively.

Table 3 shows data of a panel for cathode ray tube of which effective screen diameter D along the diagonal axis of the glass panel is 760 mm (32 inches), aspect ratio is 16:9, center wall thickness of the face portion is 19.0 mm, and minimum average radius of curvature of the outer surface of the face portion is 100,000 mm.

In Table 3, the panels for cathode ray tube according to the present invention represented by Samples 2 to 8 resulted in that the weight was reduced by about 1.9 kg at the maximum compared to the conventional panel for cathode ray tube of Sample 1, and that the vacuum tensile stress at the seal edge portion when used as a glass bulb was less than the standard value of 8.4 MPa for all Samples. Further, in the panels for cathode ray tube according to the present invention, the amount of inclination/deformation of the skirt portion immediately after forming was much suppressed compared to the conventional panel for cathode ray tube of Sample 1.

Samples 9 to 13 show comparative examples, and as for Samples 9 to 11, though the weight was reduced compared to Sample 1 of the conventional example, it was impossible to suppress the vacuum tensile stress to less than 8.4 MPa. As for Samples 12 and 13 of comparative examples, though the vacuum tensile stress was suppressed to less than 8.4 MPa, it was impossible to reduce the weight less than that of Sample 1 of the conventional example.

Figure 7:
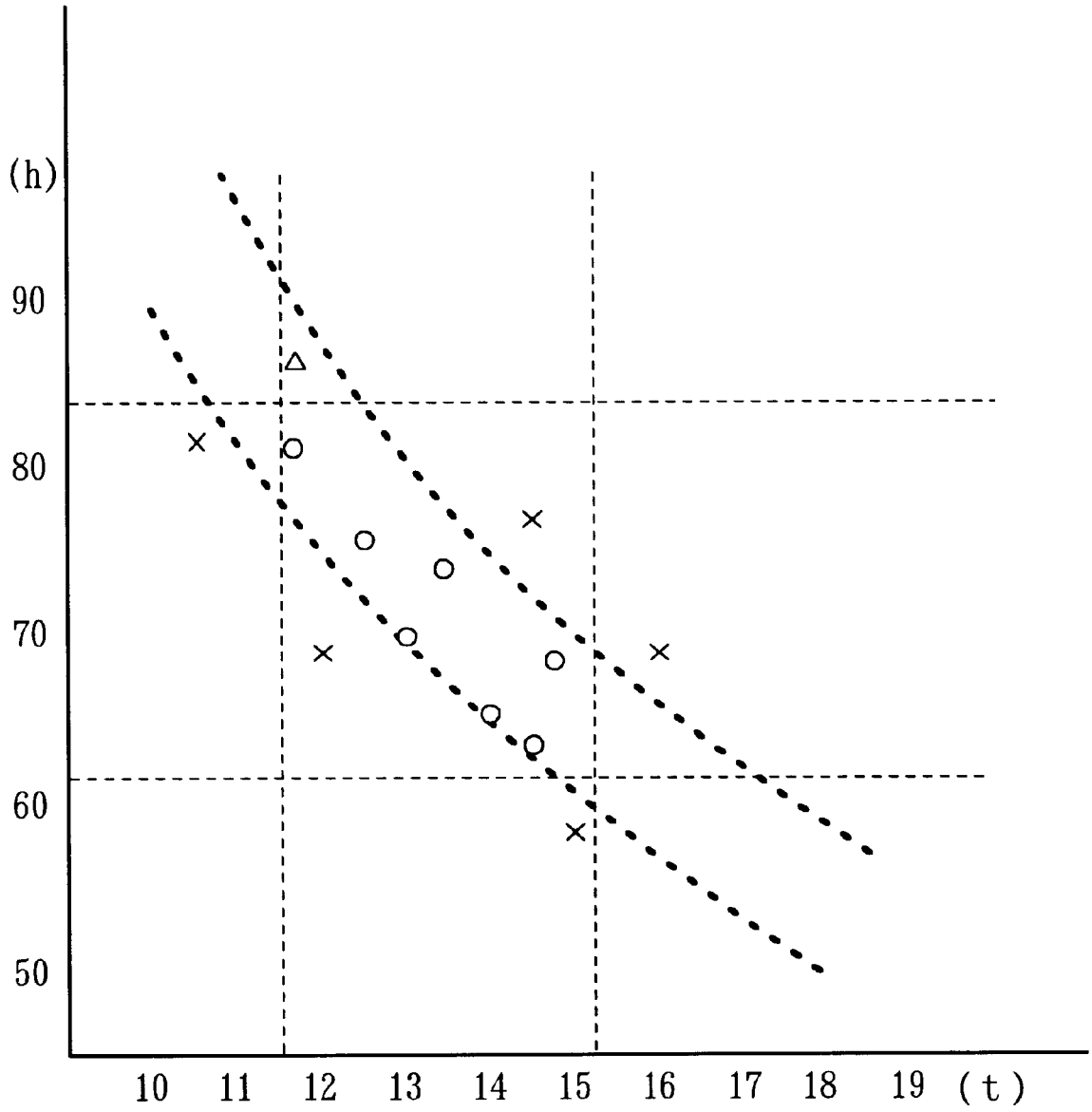
FIG. 7 is a graph showing the data of Table 3 wherein the horizontal axis represents "t" and the vertical axis represents "h"

FIG. 7 is a graph showing that the data of Table 3 are plotted, wherein the horizontal axis represents "t" and the vertical axis represents "h". The symbol Δ represents Sample 1 which is the conventional example, the symbol ○ represents glass panels of Samples 2 to 8 according to the present invention wherein the desired mechanical strength and weight reduction required for a glass bulb were accomplished, and the symbol X represents Samples 9 to 13 which are the comparative examples wherein at least one of the desired mechanical strength and weight reduction required for a glass bulb was not accomplished. The dotted lines shown in FIG. 7 denote graphs of: h=0.08D, h=0.11D, t=0.015D, t=0.020D, $t \times h=(D/25.4)^2$, and $t \times h=(D/25.4+2.5)^2$, respectively.

Table 4 shows data of a panel for cathode ray tube of which effective screen diameter D along the diagonal axis of the glass panel is 860 mm (36 inches), aspect ratio is 16:9, center wall thickness of the face portion is 20 mm, and minimum average radius of curvature of the outer surface of the face portion is 50,000 mm.

In Table 4, the panels for cathode ray tube according to the present invention represented by Samples 2 to 8 resulted in that the weight was reduced by about 2 kg at the maximum compared to the conventional panel for cathode ray tube of Sample 1, and that the vacuum tensile stress at the seal edge portion when used as a glass bulb was less than the standard value of 8.4 MPa for all Samples. Further, in the panels for cathode ray tube according to the present invention, the amount of inclination/deformation of the skirt portion immediately after forming was much suppressed compared to the conventional panel for cathode ray tube of Sample 1.

Samples 9 to 13 show comparative examples, and as for Samples 9 to 11, though the weight was reduced compared to Sample 1 of the conventional example, it was impossible to suppress the vacuum tensile stress to less than 8.4 MPa. As for Samples 12 and 13 of comparative examples, though the vacuum tensile stress was suppressed to less than 8.4 MPa, it was impossible to reduce the weight less than that of Sample 1 of the conventional example.

Figure 8:
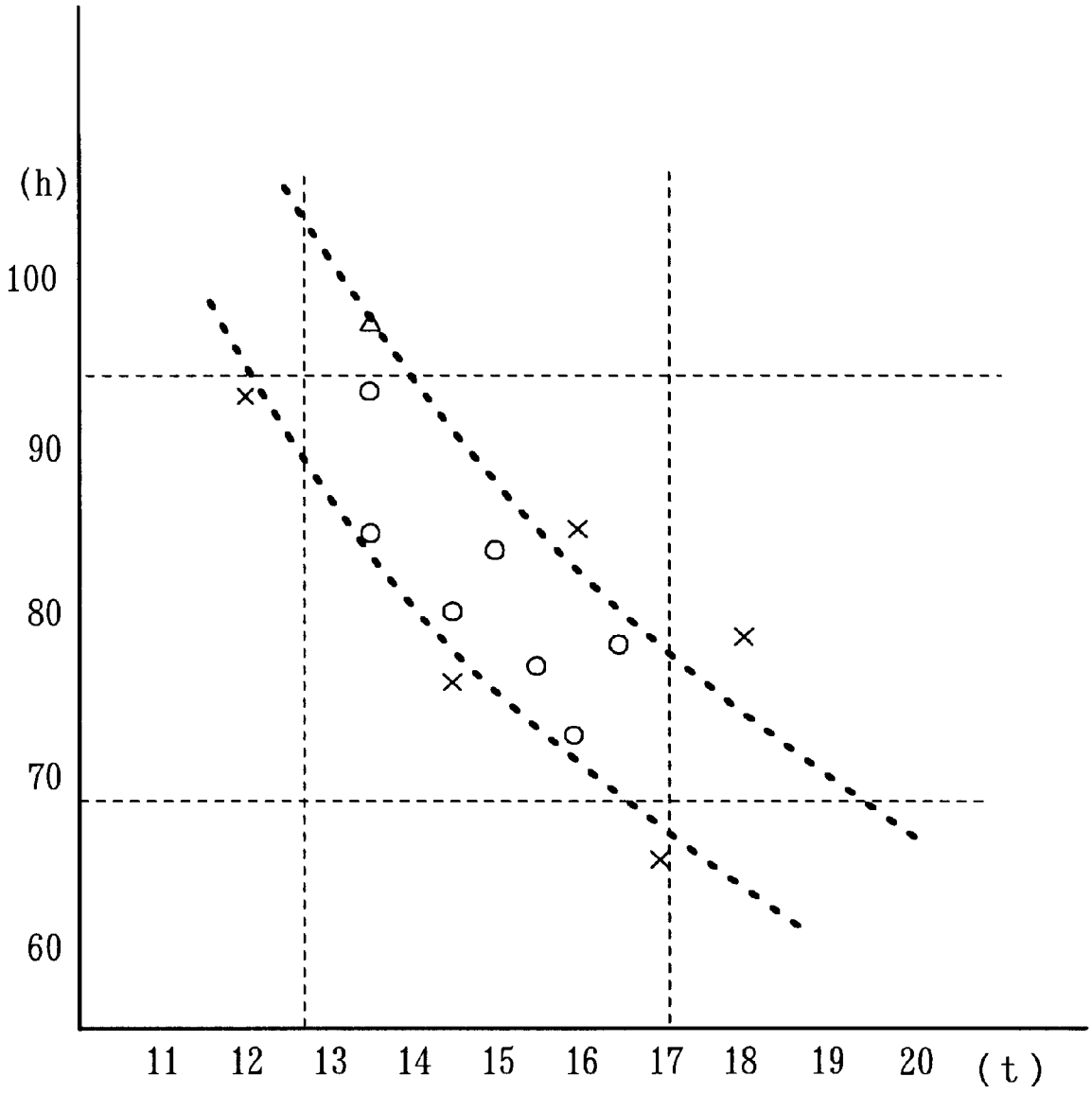
FIG. 8 is a graph showing the data of Table 4 wherein the horizontal axis represents "t" and the vertical axis represents "h".

FIG. 8 is a graph showing that the data of Table 4 are plotted, wherein the horizontal axis represents "t" and the vertical axis represents "h". The symbol Δ represents Sample 1 which is the conventional example, the symbol ○ represents glass panels of Samples 2 to 8 according to the present invention wherein the desired mechanical strength and weight reduction required for a glass bulb were accomplished, and the symbol X represents Samples 9 to 13 which are the comparative examples wherein at least one of the desired mechanical strength and weight reduction required for a glass bulb was not accomplished. The dotted lines shown in FIG. 8 denote graphs of: h=0.08D, h=0.11D, t=0.015D, t=0.020D, $t \times h=(D/25.4)^2$, and $t \times h=(D/25.4+2.5)^2$, respectively.

FIGS. 5 to 8 revealed that in the case of the glass panels whose effective screen diameters D(mm) along diagonal axis of the glass panel are 510 and 600, i.e., those having D in the range of approximately $500 \leqq D < 650$, the desired mechanical strength and weight reduction required for a glass bulb can be accomplished by setting "t" and "h" in the ranges of $0.07D \leqq h \leqq 0.11D$, $0.015D \leqq t \leqq 0.025D$ and $(D/25.4)^2 \leqq t \times h \leqq (D/25.4+3)^2$, and that in the case of the glass panels whose effective screen diameters D(mm) along diagonal axis of the glass panel are 760 and 860, i.e., those having D of 650 or more, the desired mechanical strength and weight reduction required for a glass bulb can be accomplished by setting "t" and "h" in the ranges of $0.08D \leqq h \leqq 0.11D$, $0.015D \leqq t \leqq 0.020D$ and $(D/25.4)^2 \leqq t \times h \leqq (D/25.4+2.5)^2$.

In addition, when the glass wall thickness t of the seal edge surface of the skirt portion and the center wall thickness of the face portion of the present invention are compared, the former is smaller than the latter. Thus, it was confirmed that desired mechanical strength can be achieved even though the glass wall thickness t of the seal edge surface of the skirt portion is smaller than the center wall thickness of the face portion of the panel for cathode ray tube.

(Utility in the Industrial Field)

According to the glass panel for cathode ray tube of the present invention, by setting the distance h along the tube axis in the short axis of the glass panel from a contact between the effective screen end of the inner surface of the glass panel and the blend R portion to the seal edge surface of the skirt portion, the glass wall thickness t of the seal edge surface, and the product thereof in the predetermined ranges, it is possible to reduce the weight by shortening the skirt portion while retaining the mechanical strength as a glass bulb, as well as to suppress the deformation amount of the skirt portion immediately after forming.

TABLE 1

| Sample No. | Skirt length h (mm) | Wall thickness of seal edge surface t (mm) | Maximum vacuum tensile stress (MPa) | Panel weight (kg) |
|---|---|---|---|---|
| 1 | 69.0 | 9.0 | 4.3 | 10.8 |
| 2 | 55.0 | 9.0 | 5.9 | 10.3 |
| 3 | 55.0 | 8.0 | 7.8 | 10.0 |
| 4 | 49.0 | 9.0 | 7.2 | 9.9 |
| 5 | 48.0 | 10.8 | 6.8 | 10.5 |
| 6 | 43.0 | 12.0 | 6.9 | 10.6 |
| 7 | 43.0 | 10.0 | 8.3 | 9.8 |
| 8 | 40.0 | 11.0 | 8.3 | 10.0 |
| 9 | 37.0 | 12.0 | 8.3 | 10.3 |
| 10 | 55.0 | 7.0 | 8.6 | 9.7 |
| 11 | 40.0 | 8.5 | 8.8 | 9.6 |
| 12 | 35.0 | 12.5 | 8.5 | 10.4 |
| 13 | 51.0 | 11.5 | 6.4 | 10.8 |
| 14 | 40.0 | 13.5 | 6.5 | 10.9 |

Effective screen area on diagonal axis: D=510 mm

Minimum value of outer surface average radius of curvature: 33,000 mm

Center wall thickness of face portion: 15 mm

TABLE 2

| Sample No. | Skirt length h (mm) | Wall thickness of seal edge surface t (mm) | Maximum vacuum tensile stress (MPa) | Panel weight (kg) |
|---|---|---|---|---|
| 1 | 76.1 | 9.5 | 7.0 | 14.8 |
| 2 | 66.0 | 9.5 | 7.5 | 14.3 |
| 3 | 59.0 | 9.5 | 7.9 | 14.0 |
| 4 | 55.0 | 12.0 | 7.8 | 14.5 |
| 5 | 55.0 | 10.0 | 8.2 | 13.8 |
| 6 | 52.0 | 11.0 | 8.3 | 13.9 |
| 7 | 51.0 | 13.0 | 8.3 | 14.2 |
| 8 | 47.0 | 14.5 | 8.0 | 14.7 |
| 9 | 45.0 | 13.0 | 8.3 | 14.0 |
| 10 | 66.0 | 8.5 | 8.8 | 14.0 |
| 11 | 50.0 | 10.0 | 8.6 | 13.6 |
| 12 | 41.0 | 14.5 | 8.6 | 14.4 |
| 13 | 58.0 | 12.5 | 7.6 | 14.8 |
| 14 | 51.0 | 15.5 | 6.4 | 15.2 |

Effective screen area on diagonal axis: D=600 mm

Minimum value of outer surface average radius of curvature: 30,000 mm

Center wall thickness of face portion: 14.8 mm

TABLE 3

| Sample No. | Skirt length h (mm) | Wall thickness of seal edge surface t (mm) | Maximum vacuum tensile stress (MPa) | Panel weight (kg) |
|---|---|---|---|---|
| 1 | 85.5 | 11.5 | 7.2 | 26.0 |
| 2 | 81.5 | 11.5 | 7.5 | 25.6 |
| 3 | 75.0 | 12.0 | 7.7 | 25.1 |
| 4 | 74.0 | 13.5 | 7.3 | 25.7 |
| 5 | 70.0 | 13.0 | 7.9 | 25.2 |
| 6 | 68.0 | 14.7 | 7.5 | 25.9 |
| 7 | 65.0 | 14.0 | 8.3 | 25.2 |
| 8 | 62.0 | 14.5 | 8.3 | 25.2 |
| 9 | 81.5 | 10.5 | 8.6 | 25.4 |
| 10 | 67.0 | 12.5 | 8.4 | 24.7 |
| 11 | 57.0 | 15.0 | 8.6 | 25.0 |
| 12 | 77.0 | 14.5 | 6.9 | 27.0 |
| 13 | 68.0 | 16.0 | 6.9 | 26.5 |

Effective screen area on diagonal axis: D=760 mm

Minimum value of outer surface average radius of curvature: 100,000 mm

Center wall thickness of face portion: 19.0 mm

TABLE 4

| Sample No. | Skirt length h (mm) | Wall thickness of seal edge surface t (mm) | Maximum vacuum tensile stress (MPa) | Panel weight (kg) |
|---|---|---|---|---|
| 1 | 97.2 | 13.5 | 7.4 | 37.0 |
| 2 | 93.3 | 13.5 | 7.7 | 36.5 |
| 3 | 85.1 | 13.5 | 8.0 | 35.6 |
| 4 | 84.0 | 15.0 | 7.9 | 36.5 |
| 5 | 79.8 | 14.5 | 8.2 | 35.0 |
| 6 | 78.0 | 16.5 | 7.3 | 36.8 |
| 7 | 76.9 | 15.5 | 8.3 | 36.0 |
| 8 | 73.0 | 16.0 | 8.3 | 35.5 |
| 9 | 93.3 | 12.0 | 9.2 | 35.4 |
| 10 | 74.0 | 14.5 | 8.5 | 34.7 |
| 11 | 65.0 | 17.0 | 8.6 | 35.0 |
| 12 | 85.0 | 16.0 | 7.0 | 37.2 |
| 13 | 78.0 | 18.0 | 7.0 | 37.2 |

Effective screen area on diagonal axis: D=860 mm

Minimum value of outer surface average radius of curvature: 50,000 mm

Center wall thickness of face portion: 20 mm

What is claimed is:

1. A glass panel for cathode ray tube comprising:

a face portion of substantially rectangular shape; and a skirt portion connected with a periphery of the face portion via a blend R portion and having a seal edge surface for sealing with a funnel, wherein an effective screen diameter D(mm) of the glass panel along a diagonal axis thereof is in the range of $500 \leqq D < 650$;

an average radius of curvature of an outer surface of the face portion is more than or equal to 10,000 mm in any radial direction passing the center of the face portion; and a distance h(mm) along a tube axis from a contact between an effective screen end of an inner surface of the glass panel and the blend R portion to the seal edge surface at least in a short axis of the glass panel, and a glass wall thickness t (mm) of the seal edge surface satisfy the relationships of: $0.07D \leqq h \leqq 0.11D$, $0.015D \leqq t \leqq 0.025D$ and $(D/25.4)^2 \leqq t \times h \leqq (D/25.4+3)^2$.

2. A glass panel for cathode ray tube comprising:

a face portion of substantially rectangular shape; and a skirt portion connected with a periphery of the face portion via a blend R portion and having a seal edge surface for sealing with a funnel, wherein an effective screen diameter D(mm) of the glass panel along a diagonal axis thereof is more than or equal to 650;

an average radius of curvature of an outer surface of the face portion is more than or equal to 10,000 mm in any radial direction passing the center of the face portion; and a distance h(mm) along a tube axis from a contact between an effective screen end of an inner surface of the glass panel and the blend R portion to the seal edge surface at least in a short axis of the glass panel, and a glass wall thickness t (mm) of the seal edge surface satisfy the relationships of: $0.08D \leqq h \leqq 0.11D$, $0.015D \leqq t \leqq 0.020D$ and $(D/25.4)^2 \leqq t \times h \leqq (D/25.4+2.5)^2$.

3. The glass panel for cathode ray tube of claim 1 or 2, wherein the glass wall thickness of the seal edge surface is smaller than a center wall thickness of the face portion of the glass panel for cathode ray tube.

* * * * *